US005421573A

United States Patent [19]

Kawamatsu

[11] Patent Number: 5,421,573

[45] Date of Patent: Jun. 6, 1995

[54] GOLF CLUB SHAFT

[75] Inventor: Hideaki Kawamatsu, Takarazuka, Japan

[73] Assignee: Sumitomo Rubber Industries, Ltd., Kobe, Japan

[21] Appl. No.: 66,241

[22] Filed: May 25, 1993

[30] Foreign Application Priority Data

Jun. 10, 1992 [JP] Japan ..... 4-177521

[51] Int. Cl.[6] ..... A63B 53/10

[52] U.S. Cl. ..... 273/80 B; 273/DIG. 23

[58] Field of Search ..... 273/80 R, 80 B, DIG. 7, 273/DIG. 23, 73 F; 156/187, 188, 189, 190, 173; 43/18.1, 18.5; 138/129, 137, DIG. 2; 428/36.3, 36.91, 34.6, 246, 113

[56] References Cited

U.S. PATENT DOCUMENTS 3,998,458 12/1976 Inoue ..... 273/80 R
4,000,896 1/1977 Lauraitis ..... 273/80 R
4,135,035 1/1979 Branen ..... 428/377
4,157,181 6/1979 Cecka ..... 273/80 R
4,319,750 3/1982 Roy ..... 273/80
4,889,575 12/1989 Roy ..... 273/DIG. 23
5,088,735 2/1992 Shigetoh ..... 273/DIG. 23
5,143,374 9/1992 Shibasaki ..... 273/80 B
5,156,396 10/1992 Akatsuka ..... 273/80 B

*Primary Examiner*—Sebastiano Passaniti
*Attorney, Agent, or Firm*—Armstrong, Westerman, Hattori, McLeland & Naughton

[57] ABSTRACT

The proportion of the torsional rigidity of a base end side grip portion to that of an end side portion fitted with a club head ranges between (1:1) and (4:1). As a result, a golf club shaft arranged so as to have such a proportion of torsional rigidity is increased in the torsional angle of the base end side grip portion thereof as compared with the end side portion thereof which is fitted with the club head thereof.

6 Claims, 5 Drawing Sheets

GOLF CLUB SHAFT

BACKGROUND AND SUMMARY OF THE INVENTION

The present invention relates to a golf club shaft. In general, the golf club shaft is subjected to torsion while it is swung. In this case, an amateur golfer who holds the golf club shaft can perceive the degree of the torsion thereof while swinging it if a base end side grip portion thereof has a proportion of more than 25 in the torsional angle thereof to the torsional angle of 100 of an end side portion thereof which is fitted with a club head. However, if the base end side grip portion of the golf club shaft is less than 25 in the proportion of the torsional angle thereof to that of the end side portion thereof which is fitted with the club head, a limited number of professional golfers alone who have cultivated fine senses for perceiving the torsion of the golf club shafts in their training are capable of feeling their torsional degrees. This is as experimentally confirmed.

On the other hand, in a conventional golf club shaft made of reinforced fiber or other similar material, if the end side portion thereof which is fitted with a club head is 1 in the torsional rigidity Td thereof, the base end side grip portion thereof is more than 6 in the torsional rigidity Tc thereof, as shown in FIG. 5.

For this reason, in the conventional golf club shaft, the base end side grip portion of the golf club shaft is 17 or below in the proportion of the torsional angle thereof to that of 100 of the end side portion thereof to which the club head is attached. Therefore, an amateur golfer can not feel the torsional degree of the conventional club shaft while swinging it.

Under the circumstances, when the conventional golf club shaft undergoes unusual torsion which can be caused by irregular swing thereof, an amateur golfer who holds this conventional golf club shaft is not allowed to remedy the unusual torsion thereof.

However, if the conventional golf club shaft is reduced in the entire torsional rigidity thereof as shown with the two-dot chain line in FIG. 5, the amateur golfer is able to perceive torsion thereof while swinging it, while on the other hand, reduction in the torsional rigidity of the entire conventional golf club shaft excessively increases torsion of the end side portion thereof to which the club head is attached, and this can not allow the club head to remain constant in the direction thereof when the golf club shaft is swung, thereby causing a disadvantage or problem in which the conventional golf club shaft can not achieve any shot precisely in the direction as intended.

It is therefore an object of the present invention to provide for a golf club shaft which allows an amateur golfer to perceive the torsional degree thereof while swinging it, thereby achieving a shot thereby precisely in the intended direction.

BRIEF DESCRIPTION OF THE DRAWINGS

The present invention will be described with reference to the accompanying drawings, in which.

DESCRIPTION OF THE PREFERED EMBODIMENTS

Preferred embodiments of the golf club shaft according to the present invention will be described with reference to the accompanying drawings.

Figure 1:
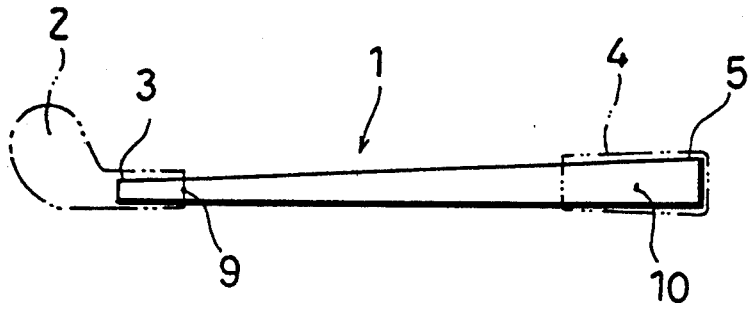
FIG. 1 is a side view of the golf club shaft according to a first preferred embodiment of the present invention.

FIG. 1 shows a first preferred embodiment of the golf club shaft 1 according to the present invention, and this golf club shaft 1 is formed in a tapered configuration so that it is generally decreased in the diameter thereof from a base end portion 5 thereof to an end portion 3 thereof.

The end portion 3 of the golf club shaft is fitted with a wood, iron or metal club head 2, and the base end portion 5 thereof is mounted with a grip 4.

Figure 2:
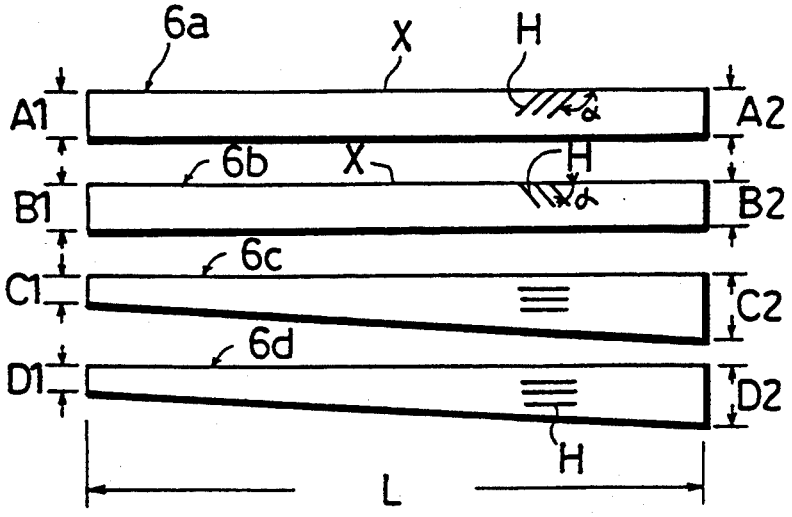
FIG. 2 is a plan view showing a first, a second, a third and a fourth seat body.

The golf club shaft 1 is manufactured by using what is called the sheet winding technique or the filament winding technique, and other similar manufacturing technique. The sheet winding technique is also called the prepreg technique. In the seat winding technique, a plurarity of reinforced fiber sheet bodies (four sheets in FIG. 2) impregnated with a thermo-setting resin, namely, a first sheet body *6a*, a second sheet body *6b*, a third sheet body *6c* and a fourth sheet body *6d* such as respectively illustrated in FIG. 2 are wound in a cylindrical configuration as later described in detail.

An example of the reinforced fiber of which the sheet bodies are made is a carbonic fiber such as "M46J" (manufactured by Toray Industries, Inc., Japan) for the first sheet body *6a* and the second sheet body *6b*, and "T300" (manufactured by Toray Industries, Inc., Japan) for the third sheet body *6c* and the fourth sheet body *6d*.

The first sheet body *6a*, the second sheet body *6b*, the third sheet body *6c* and the fourth sheet body *6d* are in a configuration of a strip of plate, and are furnished with predetermined thickness and size. The first sheet body *6a* is formed in a rectangular configuration in which width A1 of the end portion thereof is substantially equal to width A2 of the base end portion thereof. The second sheet body *6b* is also rectangularly formed such that width B1 of the end portion thereof is the substantially same as width B2 of the base end portion thereof. That is to say, in the first sheet body *6a* and the second sheet body *6b*, their widths remains substantially constant over their overall length.

The third sheet body 6c is formed in a wedge-shaped configuration such that width C2 of the base end portion thereof is larger than width C1 of the end portion thereof, and the fourth sheet body 6d is also shaped in a wedge-shaped configuration such that the width C2 of the base end portion thereof is larger than the width C1 of the end portion thereof. As a result, the third sheet body 6c and the fourth sheet body 6d are generally increased in their width from their end portions to their base end portions.

More specifically, if the first sheet body 6a, and the second sheet body 6b, the third sheet body 6c, and the fourth sheet body 6d are, for example, approximately 1000 mm in their overall length L, their widths A1, A2, B1 and B2 respectively ranges between 60 mm and 70 mm, their widths C1 and D1 between 51 mm and 61 mm, and the width C2 and D2 between 108 mm and 118 mm.

Also, the first sheet body 6a and the second sheet body 6b have the material reinforced fibers longitudinally slanted in their directions H. The third sheet body 6c and the fourth sheet body 6d have the material reinforced fibers arranged in substantially parallel with their longitudinal directions.

Specifically, the slanting angle $\alpha$ of the reinforced fibers to the longitudinal side X is approximately 135 degrees in the first sheet body 6a and approximately 45 degrees in the second shaft body 6b. That is to say, if the angles of 135 degrees and 45 degrees are respectively attained precisely or approximately for the slanting angles of the reinforced fibers in the first sheet body 6a and the second sheet body 6b, the golf club shaft which comprises these sheet bodies 6a and 6b achieves the greatest torsional rigidity thereof.

A description is next given of the golf club shaft which is made of the first sheet body 6a, the second sheet body 6b, the third sheet body 6c and the fourth sheet body 6d.

Figure 4:
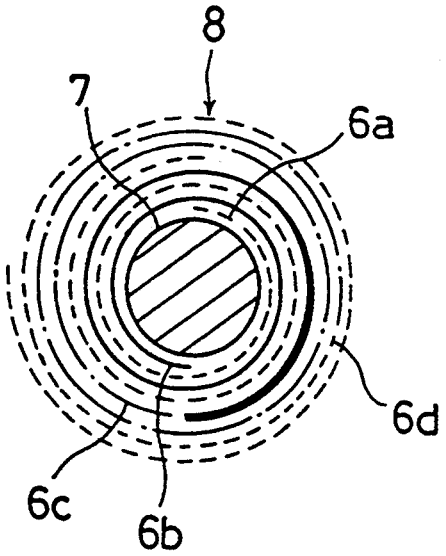
FIG. 4 is an explanatory diagram of a method for wrapping each seat body around the mandrel.

First of all, as shown in FIG. 4, the first sheet body 6a and the second sheet body 6b are wrapped around the outer circumferential surface of a mandrel 7.

Figure 3:
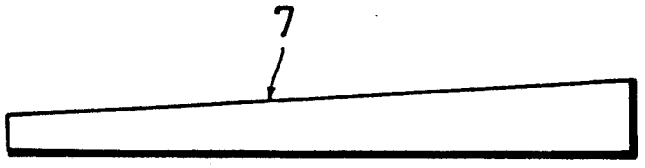
FIG. 3 is a side view of a mandrel which is applied in making the golf club shaft of the present invention.

The mandrel 7 is gradually decreased in the diameter thereof from the base end thereof to the end thereof, as shown in FIG. 3. In practice, the mandrel 7 is approximately 4.6 mm in the diameter of the end thereof and approximately 12.6 mm in that of the base end portion thereof.

Also, in order to wrap the first sheet body 6a and the second sheet body 6b around the mandrel 7, wrapping is performed such that their end portions correspond with the end portion of the mandrel 7, and their base end portions with the base end portion of the mandrel 7. Moreover, the first sheet body 6a and the second sheet body 6b are arranged so that one of them overlaps the other by approximately a semicircle when they are wrapped.

Next, the first sheet body 6a and the second sheet body 6b are wound with the third sheet body 6c, and moreover, with the fourth sheet body 6d, to thereby form a cylindrical body 8 which comprises the first sheet body 6a, the second sheet body 6b, the third sheet body 6c, and the third sheet body 6d.

The cylindrical body 8 is heated to harden the thermosetting resin impregnated in the reinforced fibers of which the first, second, third and fourth sheet bodies are made. Thereafter, the mandrel 7 is extracted from the cylindrical body 8 to separate the mandrel 7 from the cylindrical body 8. Moreover, the cylindrical body 8 is ground on the outer circumferential surface thereof, to thereby form the golf club shaft 1 shown in FIG. 1.

The conventional golf club shaft is made as described in the foregoing by using the first sheet body w, the second sheet body x, the third sheet body y and the fourth sheet body z.

Figure 12:
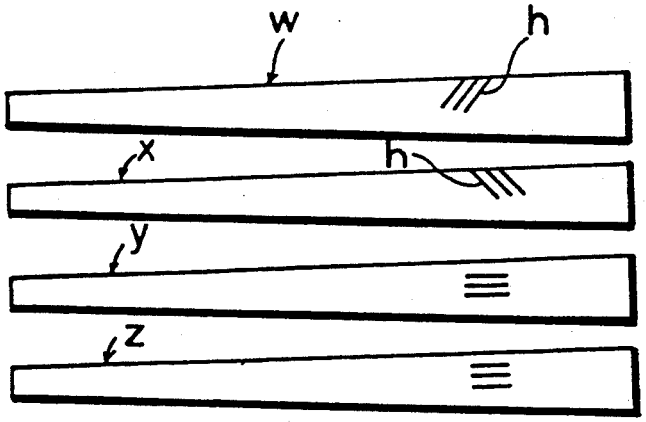
FIG. 12 is a plan view of a conventional seat body.

The third sheet body y and the fourth sheet body z are respectively identical in their arrangement with the third sheet body 6c and the fourth sheet body 6d which are applied to the golf club shaft according to the present invention, as is apparent from FIGS. 2 and 12. Also, the first sheet body w and the second sheet body x which are used to make the conventional golf club shaft have the substantially same shape as the third sheet body y and the fourth sheet body z which are also applied in the conventional golf club shaft. Moreover, in the first sheet body w and the second sheet body x of the conventional golf club shaft, the reinforced fibers are located so that the direction h thereof is identical with the direction H of the reinforced fibers in the first sheet body 6a and the second sheet body 6b of the golf club shaft according to the present invention.

Figure 5:
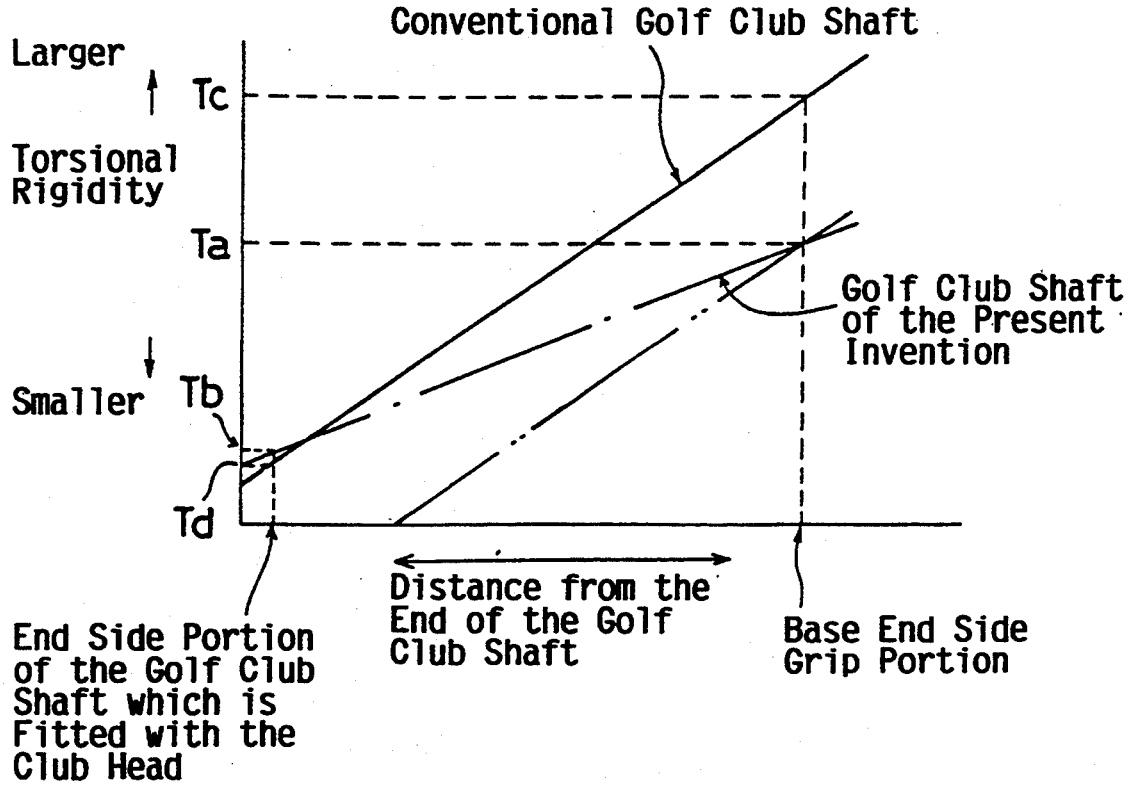
FIG. 5 is a graph which shows the difference between the golf club shaft of the present invention and the conventional golf club shaft in their torsional rigidity.

FIG. 5 is a graph which shows the measured results of the torsional rigidity of the conventional golf club shaft and that of the present invention in their several portions.

The torsional angle of the entire golf club shaft, that of the end side portion 9 fitted with the club head, and that of the base end side grip portion were respectively measured for the conventional golf club shaft and the golf club shaft of the present invention. The results of this measurement are shown in the following table 1.

TABLE 1

| | Torsional Angle of the Entire Golf Club Shaft | Torsional Angle of the End Side Portion Fitted with the Club Head | Torsional Angle of the Base End Grip Portion |
|---|---|---|---|
| Conventional Golf Club Shaft | 4.8° | 0.145° | 0.019° |
| Golf Club Shaft of the Present Invention | 4.8° | 0.112° | 0.028° |

In order to execute the measurement, the golf club shaft of the present invention and the conventional golf club shaft are respectively subjected to a torsional moment of 13.9 kg-cm.

Figure 6:
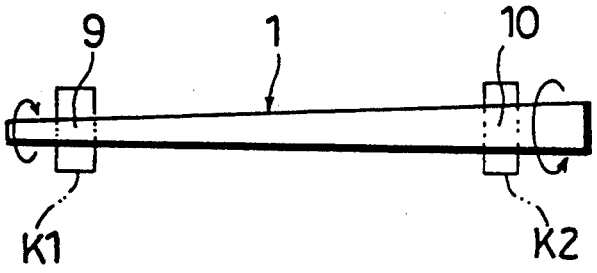
FIG. 6 is an explanatory diagram of a method for measuring the torsional angle of the entire golf club shaft.

The torsional angle of the entire golf club shaft is measured by clamping the end side portion 9 fitted with the club head, and the base end side grip portion 10 by means of chucks K1 and K2, and exerting a torsional moment of the foregoing value upon each of the end side portion and grip portion 10 through the chucks in opposite directions. See FIG. 6.

Figure 7:
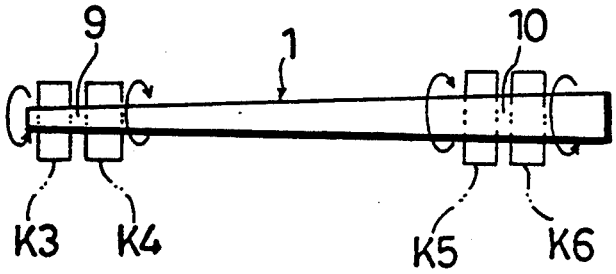
FIG. 7 is an explanatory diagram of a method for measuring the torsional angle of the end side portion of the golf club shaft which is fitted with the club head.

Also, in order to measure the torsional angle of the end side portion fitted with the club head, this end side portion 9 is clamped in two places thereof which are spaced apart by 10 mm, with the aid of chucks K3 and K4, and a torsional moment of the foregoing value is exerted upon each of the two places as chucked, in opposite directions as described in the foregoing for the measurement of the torsional angle of the entire golf club shaft. See FIG. 7.

Moreover, the torsional angle of the base end side grip portion is measured by clamping the base end side grip portion 10 at two places thereof which are spaced apart by 10 mm, with the aid of chucks K5 and K6, and exerting a torsional moment of the foregoing value upon each of the two places as chucked, in opposite directions as described in the preceding.

As is apparent from FIG. 5 and Table 1, in the conventional golf club shaft, the base end side grip portion is 6 or above in the proportion of the torsional rigidity Tc thereof to the torsional rigidity Td of 1 of the end side portion fitted with the club head, while on the other hand, in the golf club shaft according to the present invention, the base end side grip portion 10 is 4 or below in the proportion of the torsional rigidity Ta thereof to the torsional rigidity Tb of 1 of the end side portion 9 fitted with the club head.

Also, Table 1 shows that in the torsional angle of the entire golf club shaft, the conventional golf club shaft and the golf club shaft of the present invention have the same value, in the torsional angle of the end side portion fitted with the club head, the golf club shaft of the present invention is identical with or smaller than the conventional golf club shaft, and in the torsional angle of the base end side grip portion, the golf club shaft of the present invention is greater than the conventional golf club shaft by 1.4 times or more.

From the foregoing it will be understood that the golf club shaft of the present invention is furnished with a characteristic in which it is 25 or above in the proportion of the torsional angle of the base end side grip portion 10 thereof to the torsional angle of 100 of the end side portion 9 fitted with the club head, and also, the torsional rigidity Tb of the end side portion 9 fitted with the club head is identical to or greater than the torsional rigidity Td of the end side portion fitted with the club head in the conventional golf club head.

If the proportion of the torsional rigidity Ta of the base end side grip portion 10 to the torsional rigidity Tb of the end side portion fitted with the club head is set to (1:1) to (4:1), it is feasible to increase the torsional angle of the base end side grip portion 10 without impairing the torsional characteristic of the entire golf club head.

Figure 8:
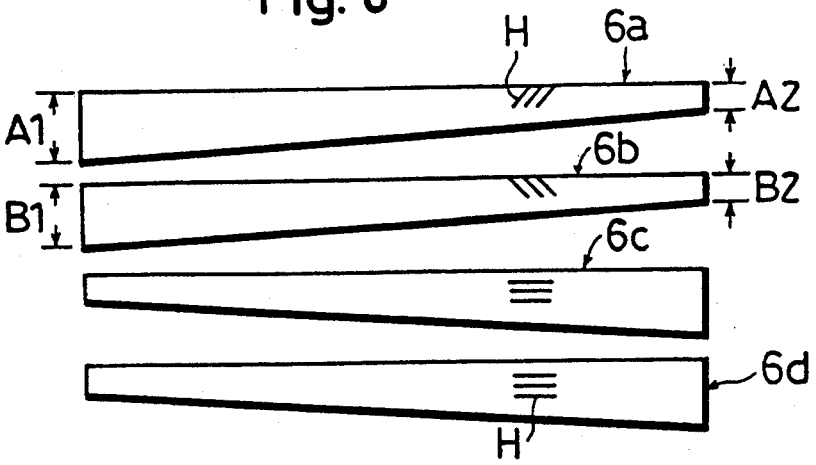
FIG. 8 is a plan view which shows a second modified example of the first and the second seat body.
Figure 9:
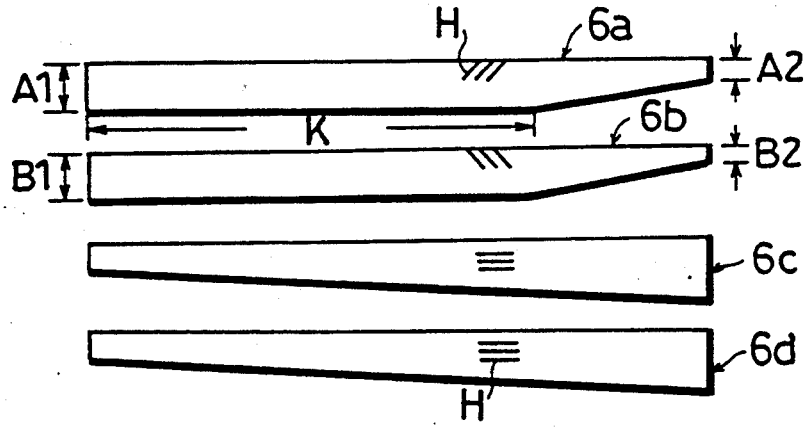
FIG. 9 is a plan view which shows a third modified example of the first and the second seat body.
Figure 10:
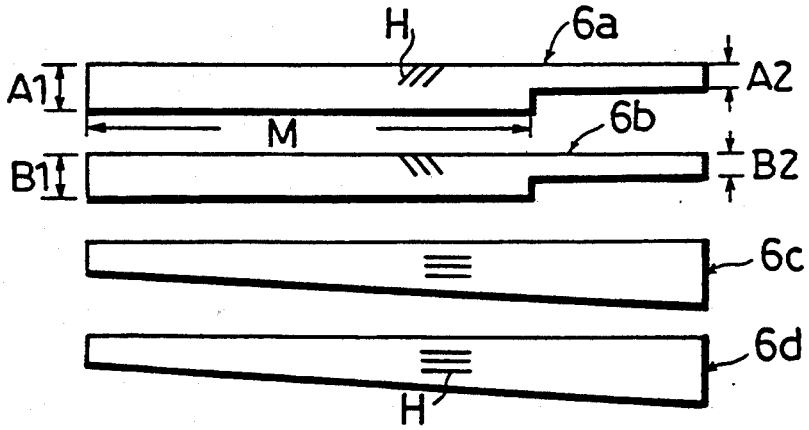
FIG. 10 is a plan view which shows a fourth modified example of the first and the second seat body.

As a matter of course, the present invention is not limited to the foregoing preferred embodiment. For example, a change in the arrangement of the first sheet body **6*a* and the second sheet body 6*b* to those illustrated in FIGS. 8 to 10 provides a golf club shaft of the torsional characteristic obtained for the golf club shaft produced by using the first sheet body 6*a* and the second sheet body 6*b* which are shown in FIG. 2. The arrangements of the first sheet body 6*a* and the second sheet body 6*b*** are specifically changed as described in the foregoing.

In FIG. 8, the first sheet body **6*a* and the second sheet body 6*b*** are formed in a wedge-shaped configuration in which the widths A1 and B1 of their end side portions are greater than the widths A2 and B2 of their base end portions. For example, the widths A1 and B1 are 65 mm to 75 mm, and the widths A2 and B2 are 45 mm to 55 mm.

In FIG. 9, the first sheet body **6*a* and the second sheet body 6*b*** remain substantially constant in their widths over a predetermined distance K of, for example, 600 mm from their ends, and are formed so as to be gradually tapered to their base ends after the predetermined distance K. Specifically, the widths A1 and B1 are, for example, 61 mm to 71 mm, and the widths A2 and B2 are such as 45 mm to 55 mm.

In FIG. 10, the first sheet body **6*a* and the second sheet body 6*b*** also remain substantially constant in their widths over a predetermined distance M of, for example, 600 mm from their ends, and are notched in a substantially L-shaped configuration in their base end portions. Specifically, the widths A1 and B1 are such as 61 mm to 71 mm, and the widths A2 and B2 are, for example, 50 mm to 60 mm. The notched base end portions may be shaped in a stair-shaped configuration.

Figure 11:
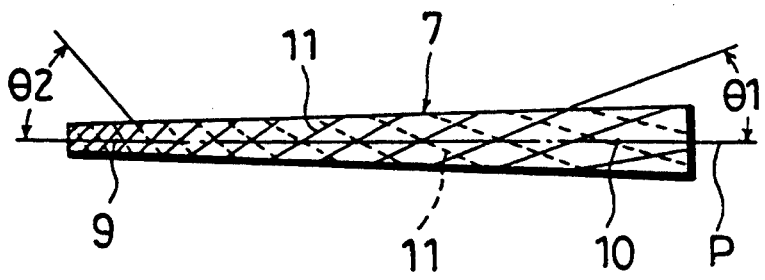
FIG. 11 is an explanatory diagram of the golf club shaft according to a second preferred embodiment of the present invention.

FIG. 11 shows an explanatory diagram of a golf club shaft produced by using the filament winding technique. In this technique, the mandrel 7 is repeatedly wound with fiber filaments 11 impregnated with a thermo-setting resin such that they cross each other, and thereafter, the fiber filaments are heated to harden them in a cylindrical configuration. Subsequently, the mandrel 7 is extracted from the cylinder made of the fiber filaments, and this cylinder is ground on the surface thereof.

When the fiber filaments are wound around the mandrel 7, the filaments winding angles $\theta 1$ and $\theta 2$ to the axis P of the mandrel 7 is gradually changed by approximately 45 degrees to 10 degrees from the end side portion 9 fitted with the club head to the base end side grip portion 10. A golf club shaft thus obtained is furnished with the characteristic of the golf club shaft produced by using the sheet bodies shown in FIG. 2.

The golf club shaft according to the present invention is arranged as described in the foregoing and shown in the accompanying drawings, and as a result, the following effects are obtained.

The golf club shaft of the present invention is allowed to reduce the torsional rigidity Ta of the base end side grip portion thereof while the torsional rigidity Tb of the end side portion 9 fitted with the club head is maintained to the torsional rigidity of the same portion of the conventional golf club head. That is to say, the present invention is capable of increasing the torsional angle of a limited place, namely, the base end side grip portion of the golf club shaft without impairing the torsional characteristic of the entire golf club shaft.

For this reason, the golf club shaft according to the present invention allows an amateur golfer to fully perceive the torsion of the golf club shaft while swinging it. As a result, the amateur golfer can remedy the torsion of the golf club shaft while swinging it, and can prevent any excessive torsion of the head of the golf club shaft when the head is subjected to impact against a golf ball. This ensures that the golf club shaft of the present invention achieves a shot precisely in the direction as intended.

Although the present invention has been fully described by way of examples with reference to the accompanying drawings, it is to be noted here that various changes and modifications will be apparent to those skilled in the art. Therefore, unless otherwise such changes and modifications depart from the scope of the present invention, they should be construed as being included therein. For example, the widths A1, A2, B1, B2, C1, C2, D1 and D2 of the sheet bodies, the directions H of the reinforced fibers, the filaments winding angles $\theta 1$ and $\theta 2$ are all alterable as included in the scope of the present invention.

I claim:

1. A golf club shaft characterized by that the proportion of the torsional rigidity of a base end side portion to be fitted with a thereof to that of an end side portion thereof which is to be fitted with a club head ranges from between (1:1) and (4:1) wherein a first, a second, a third and a fourth sheet body which are respectively made of reinforced fibers impregnated with a thermo-setting resin are wound, one over the other with said first sheet body the inner most winding, said second sheet body the second inner most winding, said third sheet body the third inner most winding and said fourth sheet body the outer most winding and into a substantially cylindrical configuration, said reinforced fibers of which the first sheet body and the second sheet body are made are respectively slanted longitudinally of each sheet body and said reinforced fibers of which the third sheet body and the fourth sheet body are made are respectively arranged substantially parallel with the longitudinal directions of the sheet bodies.

2. The golf club shaft as set forth in claim 1, wherein the first sheet body and the second sheet body remain substantially constant in their widths over their overall length, while at the same time, the third sheet body and the fourth sheet body are gradually increased in their width from said end side portion to said base end side portion.

3. The golf club shaft set forth in claim 1, wherein the first sheet body and the second sheet body are gradually decreased in width from said end side portion to said base end side portion, while, at the same time, the third sheet body and the fourth sheet body are gradually increased in their widths from said end side portion to said base ends side portion.

4. The golf club shaft as set forth in claim 1, wherein the first sheet body and the second sheet body are gradually decreased in the widths of said base end side portion in the direction of said base end side portion, and remain constant in width in their portion other than said base end portion, while at the same time, the third sheet body and the fourth sheet body are gradually increased in width from said end side portion to said base end side portion.

5. The golf club shaft as set forth in claim 1, wherein the first sheet body and the second sheet body are formed with a substantially rectangular notched portion in their base end portion, and remain constant in width in portions other than said base end portion, while at the same time, the third sheet body and the fourth sheet body are gradually increased in width from said end side portion to said base end side portion.

6. The golf club shaft as set forth in claim 1, wherein fiber elements impregnated with a thermo-setting resin are would in a substantially cylindrical configuration.

* * * * *